US005901858A

United States Patent [19]

Perry

[11] Patent Number: 5,901,858

[45] Date of Patent: May 11, 1999

[54] FISHING REEL RACK

[76] Inventor: Clifford R. Perry, 934 S. 295th Pl., Federal Way, Wash. 98003

[21] Appl. No.: 08/877,130

[22] Filed: Jun. 17, 1997

[51] Int. Cl.[6] ..... A47F 7/00

[52] U.S. Cl. ..... 211/13.1

[58] Field of Search ..... 211/13.1, 85.7, 211/70.8; 43/22

[56] References Cited

U.S. PATENT DOCUMENTS

| | | | |
|---|---|---|---|
| 1,247,938 | 11/1917 | Curtenius | 211/87.01 |
| 2,513,474 | 7/1950 | Greer | 211/87.01 |
| 2,724,811 | 11/1955 | Poupitch | 211/87.01 |
| 3,433,446 | 3/1969 | Meder | 248/316 |
| 4,003,612 | 1/1977 | Munsell | 312/245 |
| 4,378,882 | 4/1983 | Miller | 206/315 |
| 4,732,280 | 3/1988 | Nieders | 211/13 |

*Primary Examiner*—Alvin Chin-Shue
*Assistant Examiner*—Sarah Purol
*Attorney, Agent, or Firm*—Hughes, Multer & Schacht, P.S.

[57] ABSTRACT

A system and method for mounting fishing reels on a mounting surface. The system employs a base member having retaining walls and detent members. The base member is mounted on the mounting surface. Tangs on the reel are held by the detent members against the retaining walls to hold the reel in place. A stop member is formed on an inner surface of one of the retaining walls to reduce the likelihood that the reel will become inadvertently dislodged. The base member is designed to be injection molded as a single part.

15 Claims, 5 Drawing Sheets

FISHING REEL RACK

FIELD OF THE INVENTION

The present invention relates to methods and apparatus for storing and displaying fishing reels and, more particularly, to such methods and apparatus that allow fishing reels to be detachably attached to a flat surface such as a wall, ceiling, or cabinet door.

BACKGROUND OF THE INVENTION

Fishing reels are often designed for a specific style of fishing or type of fishing line or rod. Fisherman will thus often purchase a number of fishing reels so that the appropriate reel may be used in a given situation.

Additionally, fishing reels are normally detachable from rods, and the rods are often stored in tubes. So even if one reel and one rod are owned, the fisherman may want to remove the reel from the rod when the assembly is not in use so that the rod and reel may be stored separately.

In these and other cases, the fisherman is faced with the problem of storing fishing reels that are not in use.

Fishing reels are fairly delicate devices and often quite expensive. Care must be taken when storing fishing reels to ensure that they are not damaged. And in some cases the fisherman would like to avoid even scratching the finish on a fishing reel for aesthetic purposes or to avoid possible corrosion.

Thus, while it is possible simply to store fishing reels in a tackle box or the like, many fisherman would like to avoid this approach and thereby avoid damaging the reel.

RELATED ART

A professional patentability search conducted on behalf of the Applicant turned up the following U.S. Pat. Nos.: 3,433,446 issued Mar. 18, 1969 to Meder; 4,003,612 issued Jan. 18, 1977 to Munsell; 4,378,882 issued Apr. 5, 1983 to Miller; and 4,732,280 issued Mar. 22, 1988 to Nieders.

The Meder patent discloses a bracket for fishing reels. This device includes a base portion, an upper retaining loop fixed to the base portion, a lower retaining loop movable mounted on the base portion, and a spring assembly that biases the lower retaining loop towards the upper retaining loop. The base portion is mounted on a wall or the like, and prongs extending from the fishing reel are inserted into the upper and lower retaining loops. The spring-loaded lower retaining loop holds the reel securely onto the base. The Meder device is relatively complex and requires the use of two hands to insert or remove the reel.

The Munsell patent discloses a rack that separately stores rods and reels. The reels are attached to vertical rods using rings that encircle the rods. This device has somewhat limited application and cannot be used as intended inside of cabinets and the like.

The Miller patent discloses a storage box for fishing reels. Projecting from a rear wall of the box is an array of cylindrical members of approximately the same diameter as fishing rods. These members are provided with a reel attachment system similar to that employed on a fishing rod, and reels may be attached to each of the cylindrical members. The Miller device is a relatively complex, dedicated device that does not use space very efficiently.

The Nieders patent discloses a reel display rack that appears to be primarily intended for retail sales environments. This rack employs a number separate shafts to which reels are attached. The shafts each include a reel attachment system similar to that of a fishing rod. This device is relatively complex and is not well-suited for use in a home environment.

OBJECTS OF THE INVENTION

From the foregoing, it should be apparent that one object of the present invention is to provide improved fishing reel storage apparatus and methods.

Another more specific object of the present invention is to provide fishing reel storage apparatus and methods having a favorable mix of the following characteristics:

holds reels firmly in place;

locks the reels in place against inadvertent dislodgment;

can be stored in tightly confined spaces such as within a cabinet;

can be used as part of a modular system;

does not require two hands to insert and remove fishing reels;

easy to install;

accommodates most commercially available fishing reels;

no moving parts;

corrosion resistant; and simple to manufacture and market.

SUMMARY OF THE INVENTION

These and other objects are obtained by the present invention, which is a storage system or method in which a base member is attached to a mounting surface and a fishing reel is detachably attached to the base. The base member comprises first and second retaining cavities for receiving first and second tangs extending from the fishing reel. First and second detent members are arranged on the base member adjacent to the cavities to lock the tangs into the cavity against inadvertent removal.

The cavities are defined by a retaining portions formed on the base portion. The detent members are arranged on the base portion such that they deflect slightly away from the retaining portion associated therewith. When the reel is attached to the base portion, the detent members force the tangs against the retaining portions to inhibit relative movement between the reel and the base.

But the reel may be detached from the base portion simply by moving the reel against the detent members such that the tangs are no longer held against the retaining portions of the base. The reel is then moved in one direction and then another until both of the detents are no longer within the retaining cavities. This operation can be carried out with one hand.

The present invention may be embodied in a form that can be made simply and inexpensively using injection-molding techniques, contains no moving parts (other than the detent members which simply deflect), and does not require assembly other than attachment to the mounting surface.

The base member of the present invention may be attached to the mounting surface directly by screws or indirectly through a mounting plate attached to the mounting surface. The mounting plate may have a retaining mechanism formed thereon that engages one or more base members to attach them to the mounting surface. By attaching one mounting plate to a cabinet door in a residence and another to a surface on a boat, for example, the base members may be moved from one location to another as necessary with the reels attached thereto in an orderly fashion.

DETAILED DESCRIPTION

Figure 1:
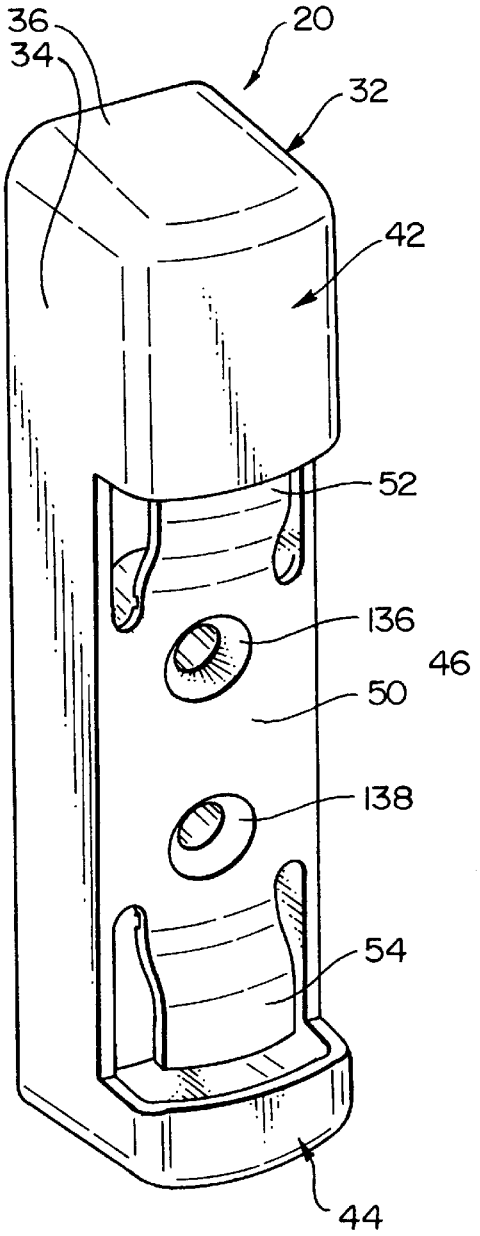
FIG. 1 is a front, perspective view of a fishing reel rack constructed in accordance with, and embodying, the principles of the present invention.
Figure 2:
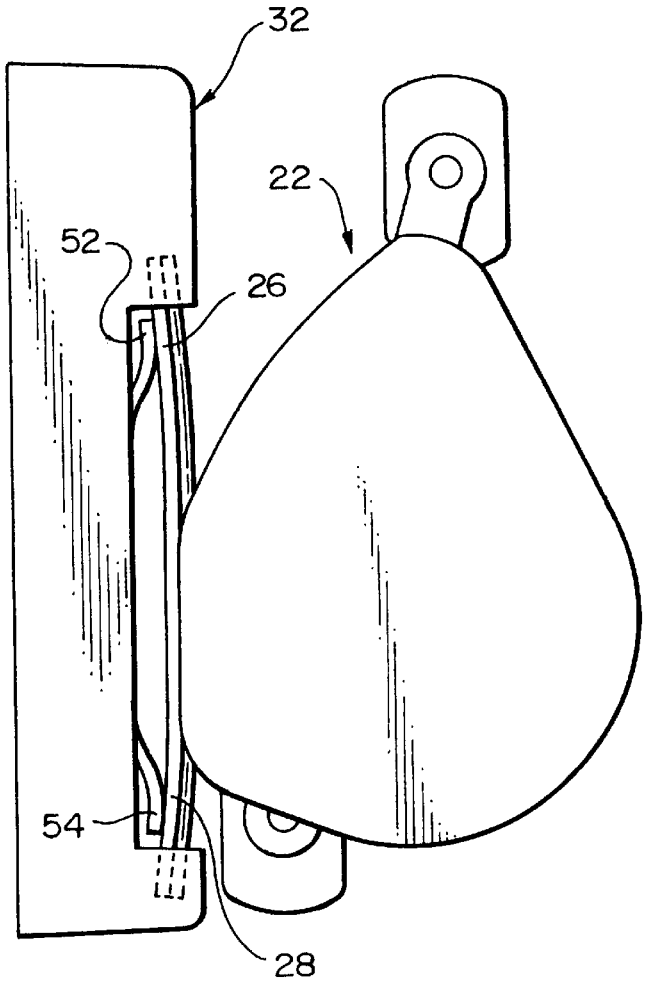
FIG. 2 is a side view depicting the attachment of a fishing reel to the rack depicted in FIG. 1.
Figure 4:
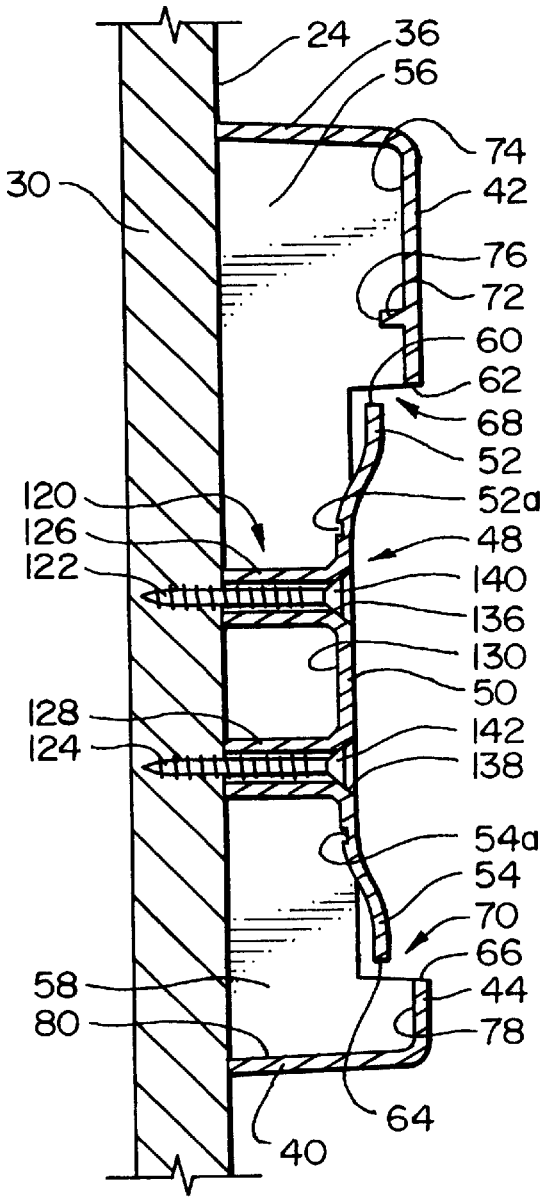
FIG. 4 is a side, cut-away view showing how the rack of FIG. 1 is attached to a mounting surface.

Referring now to FIG. 1 of the drawing, depicted at 20 therein is a storage system for fishing reels constructed in accordance with, and embodying, the principles of the present invention. As shown in FIG. 2, a fishing reel 22 is attached to the storage system 20 for storage and/or display. And as shown in FIG. 4, the storage system 20 is mounted onto a mounting surface 24; with the fishing reel 22 attached to the storage system 20 and the storage system 20 mounted onto the surface 24 at a desired location, the fishing reel 22 is safely stored and/or displayed at the desired location.

The fishing reel 22 is not per se a part of the present invention and thus will be described herein only briefly. The fishing reel 22 is designed to be attached to fishing poles of different types and thus has front and rear tangs 26 and 28 extending therefrom. These tangs 26 and 28 form part of a standard attachment system for allowing reels to be attached to poles. Thus, most fishing reels will be provided with tangs similar to those of the fishing reel 22.

Standard tangs differ only slightly if at all in thickness and in length, and the storage system 20 is designed to accept most standard tangs. The distance from tip to tip of the tangs 26 and 28 will be referred to as the span of the tangs.

The mounting surface 24 is also not per se part of the present invention. This surface can be part of any essentially planar member, but will usually be part of a wall or cabinet door. In FIG. 4, this surface 24 is the inner surface of a cabinet door 30.

Referring now again to FIG. 1, the exemplary storage system 20 comprises a base member 32. The base member 32 is formed from a single piece of injection-molded plastic. The exemplary base member 32 thus can be inexpensively mass-produced, but other less optimized base members can be designed without departing from the scope of the present invention.

Figure 3:
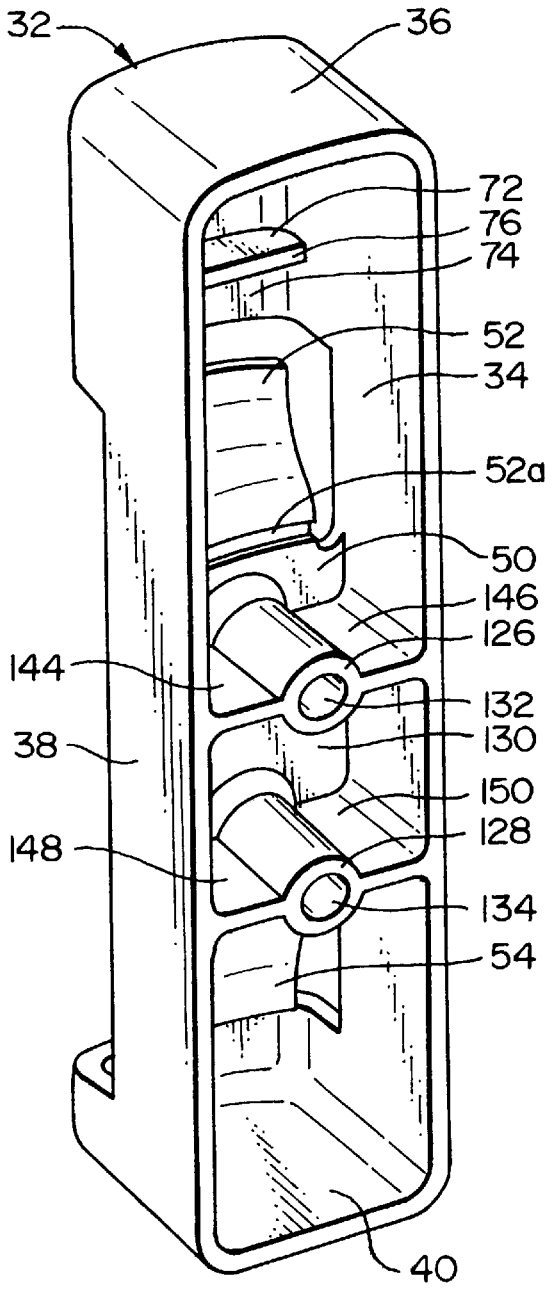
FIG. 3 is a rear perspective view of the rack depicted in FIG. 1.

As shown in FIGS. 1 and 3, the base member 32 comprises left side, top, right side, and bottom walls 34, 36, 38, and 40. Connected to the left side, top, and right side walls 34–38 is an upper retaining wall 42 of the base member 32. And connected to the left side, right side, and bottom walls 34, 38, and 40 is a lower retaining wall 44 of the base member 32. The surface area of the upper retaining wall 42 is larger than that of the lower retaining wall 44; this results in the bottom wall 40 being closer to the lower detent member 54 than the top wall 42 is to the upper detent member 52.

As perhaps best shown in FIGS. 2 and 4, notches 46 and 48 are formed in the left and right side walls 34 and 38, respectively. Extending between the side walls 34 and 38 at the notches 46 and 48 is a front wall 50. And extending from the front wall 50 towards the upper and lower retaining walls 42 and 44, respectively, are upper and lower detent members 52 and 54.

The detent members 52 and 54 are designed to deflect slightly from an original position shown in FIG. 4 when a force is applied thereto. But when the force is removed, the detent members spring back to their original positions. Lateral grooves 52*a* and 54*a* are formed at the junctures between the front wall 50 and the detent members 52 and 54 to facilitate deflection of the detent members 52 and 54.

When deflected, the detent members exert a reaction force on whatever has engaged them. This reaction force increases as the detent members deflect more severely from their original position. The plastic material out of which the base member 32 is made is selected to provide, in combination with the depth of the grooves 52*a* and 54*a*, sufficient deflection and reaction force for the purposes described below without breaking under normal use.

FIG. 4 illustrates that an upper retaining cavity 56 is defined by the top wall 36, the upper retaining wall 42, and portions of the right and left side walls 34 and 38 adjacent to the upper retaining wall 42. A similar lower retaining cavity 58 is defined by the bottom wall 40, the lower retaining wall 44, and portions of the right and left side walls 34 and 38 adjacent to the lower retaining wall 44.

When the base member 32 is upright as shown in the drawing, an upper edge 60 of the upper detent member 52 is slightly below a lower edge 62 of the upper retaining wall 42 and a lower edge 64 of the lower detent member 54 is slightly above an upper edge 66 of the lower retaining wall 44. The detent member edges 60 and 64 are also spaced slightly towards the back of the base member 32 (or towards the mounting surface 24). This allows the base member 32 to be injection-molded using a relatively simple two-part mold with a parting line parallel to the front surface 50.

The arrangement of the detent member edges 60 and 64 relative to the retaining wall edges 62 and 66 creates upper and lower gaps 68 and 70 through which the tangs 26 and 28 on the reel 22 extend when the reel 22 is attached to the storage system 20. The gaps 68 and 70 are slightly narrower than the thickness of the tangs 26 and 28 such that the detent members 52 and 54 force the tangs 26 and 28 against the retaining walls 42 and 44, as will be described in further detail below.

A stop member 72 is formed on an inner surface 74 of the upper retaining wall 42. A rear edge 76 of the stop member 72 is spaced slightly towards the back of the base member 32 relative to the inner surface 76. An inner surface 78 of the lower retaining wall 44 does not contain a similar stop member.

Figure 5:
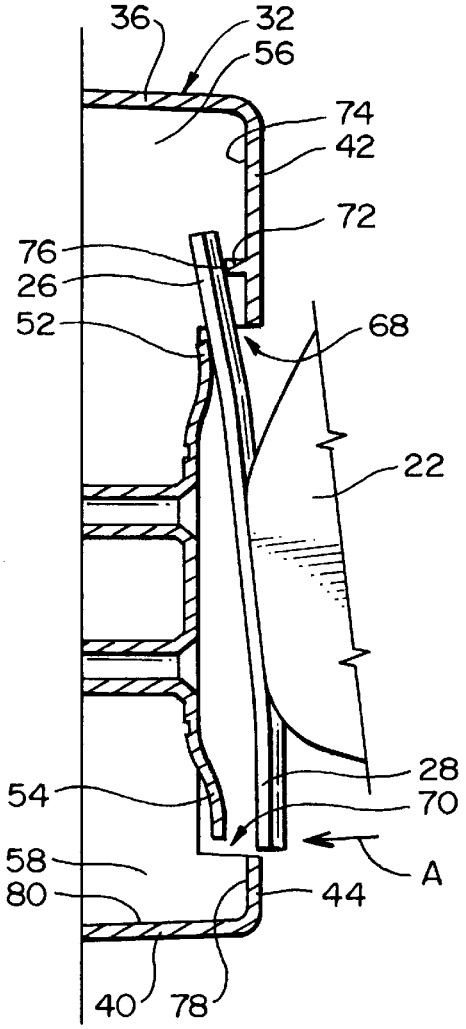
FIGS. 5–7 are side, cut-away views depicting a method of attaching a fishing reel to a mounting surface using the rack of FIG. 1.
Figure 6:
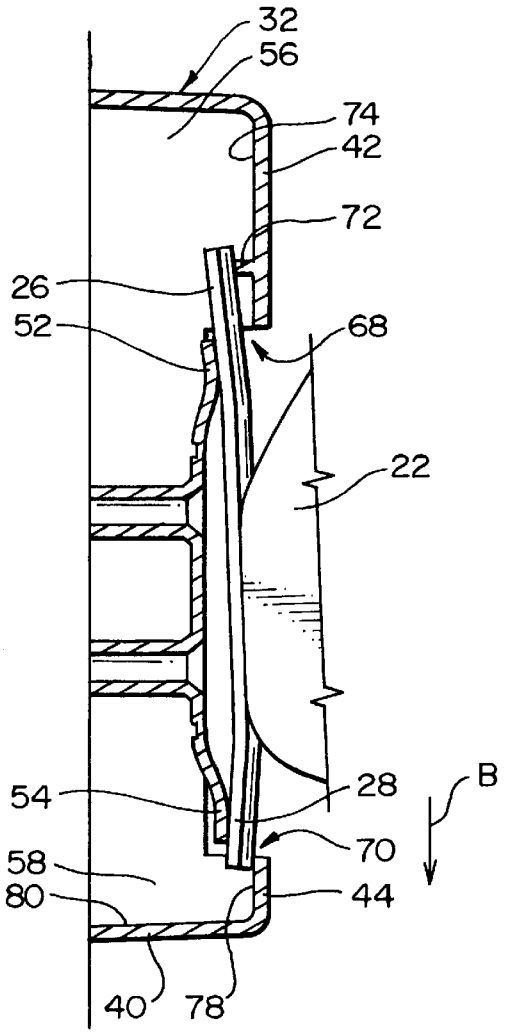
Figure 7:
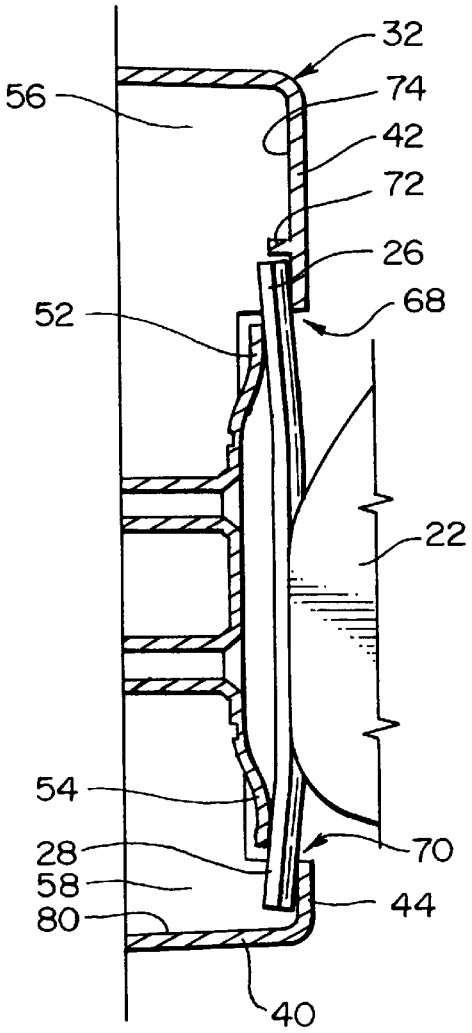
Figure 8:
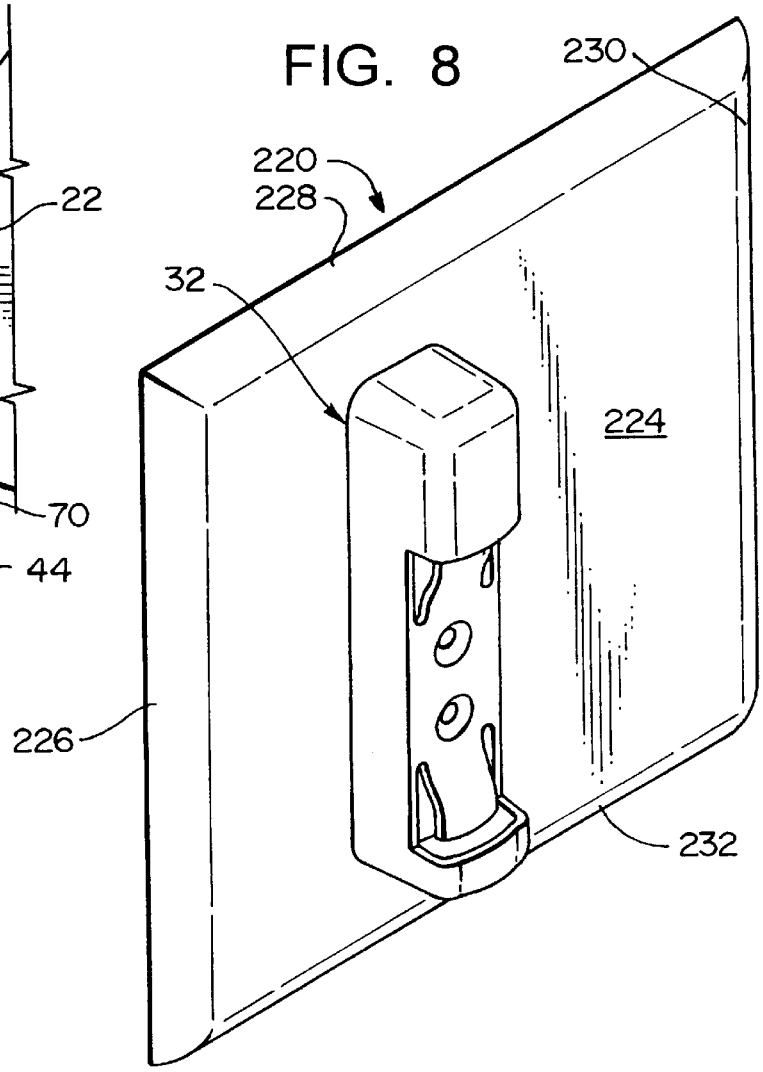
FIG. 8 is a front, perspective view depicting the rack of FIG. 1 attached to a mounting plate.

FIGS. 5–7 depict the method of attaching the fishing reel 22 to the base member 32. As shown in FIG. 5, the front tang 26 is first inserted into the upper retaining cavity 56 through the upper gap 68. At this point, the upper detent member 52 will be slightly deflected out of its normal position. When the front tang 26 is further inserted into the upper retaining cavity 56, it comes in contact both with the detent member 52 and the rear edge 76 of the stop member 72; as shown in FIG. 5, the detent member 52 will be more severely deflected out of its normal position. The top wall 36 is spaced significantly above the stop member 72 to allow sufficient room for the tang 26 to enter the retaining cavity 56 past the stop member 72.

The reel 22 is then pivoted as shown by arrow A in FIG. 5 until the lower tang 28 engages the lower detent member 54 and is adjacent to the lower gap 70; the pivot point is where the front tang 26 engages the rear surface 76 on the stop member 72. The upper detent member 52 is now deflected most severely out of its original position.

As shown in FIG. 6, the reel 22 is next slid down in the direction shown by arrow B until the lower tang 28 begins to enter the lower retaining cavity 58 through the lower gap 70. The upper detent member 52 is still severely deflected out of its original position at this point. Andy in order to enter the lower gap 70, the rear tang 28 slightly deflects the lower detent member 54 from its original position; the lower detent member 54 acts on the rear tang 28 such that the tang 28 engages an inner surface 76 of the lower retaining wall 44 as the tang 28 enters the chamber 58.

The reel 22 is next slid further down in the direction of arrow B into the position shown in FIG. 7. In this position, the front tang 26 no longer engages the stop member 72, but instead rests against the upper retaining wall inner surface 74 below the stop member 72. The lower detent member 54 is still only slightly deflected at this point. And because the surface 74 does not extend as far toward the rear as the rear surface 76 on the stop projection 72, the upper detent member 52 is also only slightly deflected.

The reel 22 is securely attached to the base member 32 when in the position shown in FIG. 7. The combined length of the tangs 26 and 28 is longer than the distance between the retaining walls 42 and 44, so the reel 22 may not be removed from the base member by inadvertent movement of the reel 22 relative to the base member 32 in the direction opposite that indicated by arrow A in FIG. 5. The detent members 52 and 54 inhibit movement of the reel 22 in the direction of arrow A. The stop member 72 and inner surface 80 of the bottom wall 40 are spaced from each other a distance only slightly longer than the span of the front and rear tangs; this substantially prevents the reel 22 from moving straight up and down when attached to the base member 32. Accordingly, random loads (such as accidental blows) on the reel 22 or mounting surface 24 will not dislodge the reel 22 from the base member 32.

But the reel 22 may be removed from the base member 32 by simple manipulation of the reel 22 in a sequence of moves that are not likely to occur inadvertently. In particular, the reel 22 is slightly pivoted such that the front tang 26 deflects the upper detent member 52 and the front tang 26 can be lifted up past the stop member 72. When the reel 22 is displaced far enough, the bottom tang can clear the lower retaining wall 44 and swing out of the retaining cavity 58. With the reel 22 slightly angled with respect to vertical, it is displaced downwardly until the front tang 68 clears the upper retaining wall 42 and exits the upper retaining cavity 56. The reel is thus completely removed from the base member 32.

As mentioned, the sequence of moves necessary to remove the reel 22 are highly unlikely to occur by random shocks on the reel 22 or mounting surface 24. And even if the right sequence of moves occurs, the first has to be of sufficient force to deflect the upper detent member into its severely deflected position, followed immediately by movement that results in the upper tang 26 clearing the stop member 72. While possible, this is highly unlikely.

The reel 22 is thus securely attached to and removed from the base member 32 using a simple sequence of moves that may be performed using only one hand. The storage system 20 thus securely attaches the reel 22 to a desired location on a mounting surface 24 and, under normal circumstances, the reel 22 will not be inadvertently detached by movement of the reel 22 and/or mounting surface 24.

While any number of means, such as adhesives, clips, and hook and loop fasteners, may be used to mount the base member 32 to the desired location on the mounting surface 24, a preferred mounting system is identified by reference character 120 in FIG. 4.

This mounting system 120 comprises first and second threaded fasteners 122 and 124 and first and second spacing members 126 and 128 extending rearwardly from a rear surface 130 of the front wall 50. The exemplary spacing members 126 and 128 are hollow cylinders that define base passageways 132 and 134 through which the fasteners 122 and 124 extend. The length of the spacing members 126 and 128 is defined by the desired distance between the front wall 50 and the mounting surface 24. The passageways 132 and 134 terminate at beveled openings 136 and 138 (FIG. 1) formed in the front wall 50.

The fasteners 122 and 124 are inserted through the openings 136 and 138 and the passageways 132 and 134. The fasteners 122 and 124 are then axially rotated until the thread themselves into the door 24. When the fasteners 122 and 124 are securely threaded into the door 30, the spacing members 126 and 128 engage the mounting surface 24 such that the front wall 50 is secured at the desired distance from the mounting surface 24. Heads 140 and 142 of the fasteners 122 and 124 are also received within the beveled openings 136 and 138 so that they do not interfere with the operation of the system 20.

The fastening system 20 thus securely mounts the base member 32 onto the door 30.

In other situations, variations on the fastening system 20 may be appropriate. For example, the most common variation would be to use anchor members when the mounting surface is on a section of drywall. Such drywall fastener anchors are commonly used in the art to spread the loads applied on the drywall over a larger surface area.

Referring for a moment to FIG. 3, it can be seen that short bracing walls 144 and 146 are formed such that they extend between the spacing member 126 and the left and right side walls 34 and 38; similar bracing walls 148 and 150 extend between the spacing member 128 and the left and right side walls 34 and 38. These bracing walls 144–150 rigidify the base member 32.

It should be apparent to one of ordinary skill in the art that the base member 32 can easily be formed by injection-molded plastic using a relatively simple two-part mold but results in a strong, rigid part.

Figure 9:
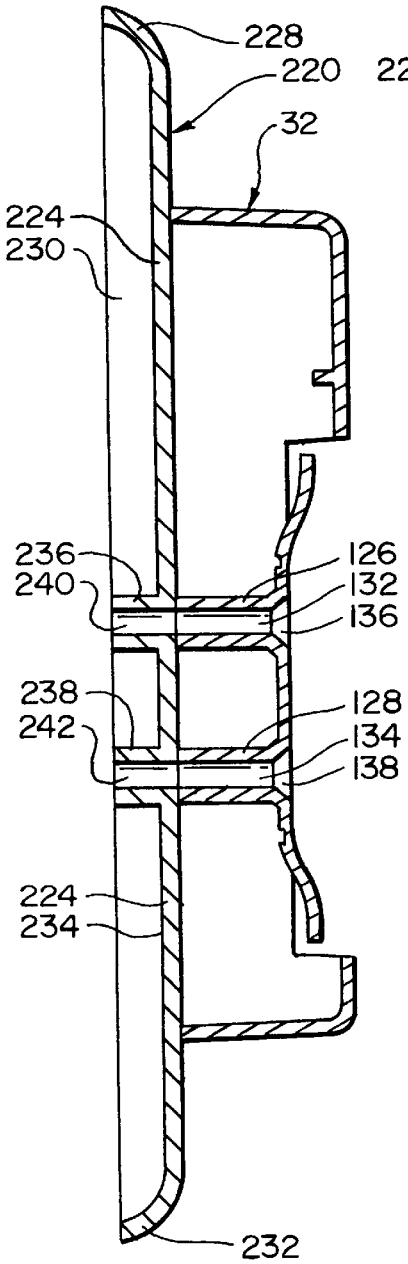
FIG. 9 is a side, cut-away view showing how the rack of FIG. 1 and mounting plate of FIG. 8 are attached to a mounting surface.
Figure 10:
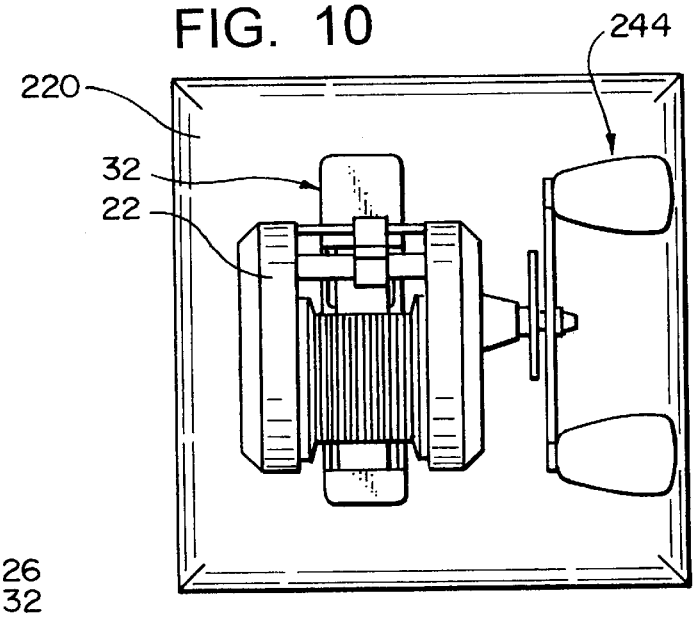
FIG. 10 is a front, elevational view showing the size relationship between an exemplary fishing reel and the mounting plate of FIG. 8.
Figure 11:
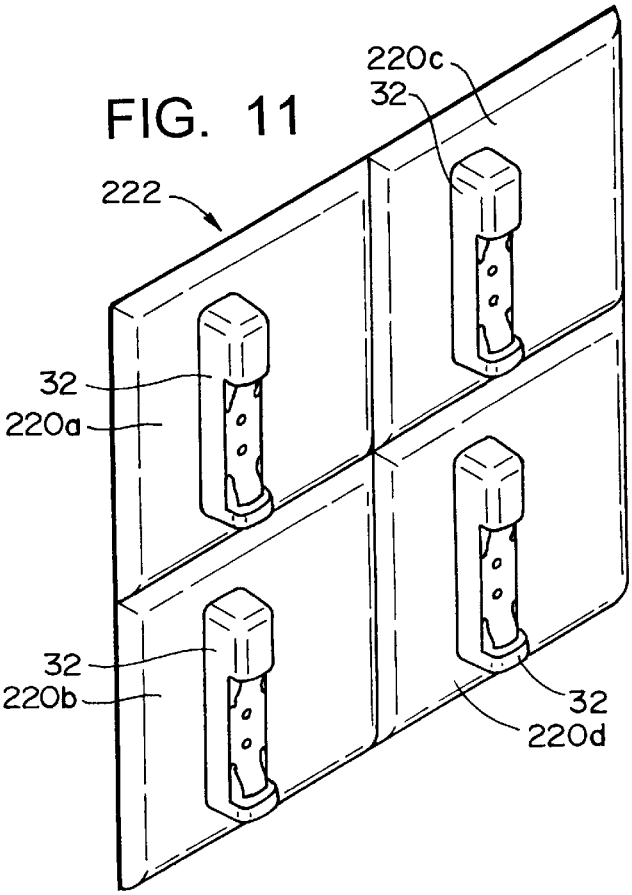
FIG. 11 is a front, perspective view depicting a plurality of racks and corresponding mounting plates arranged in an array.

Referring now to FIGS. 8–11, depicted at 220 therein is a mounting plate that may be used with the base member 32 described above. The mounting plates 220 are designed to be mounted in an array 222 of such plates 220*a–d*, as shown in FIG. 11, to mount a plurality of base members 32 at regular locations on a mounting surface.

As shown in FIG. 10, each mounting plate 220 defines a surface area that is larger than the surface area required to mount a fishing reel 22. Thus, a plurality of fishing reels may be mounted in the array 222 without interfering with each other.

FIG. 9 illustrates that the exemplary mounting plate 220 comprises a front, left side, top, right side, and bottom walls 224, 226, 228, 230, and 232, respectively. Extending from an inner surface 234 of the front wall 224 are first and second plate spacers 236 and 238. The plate spacers 236 and 238 define plate passageways 240 and 242. It should be apparent that the mounting plate 220 is or may be a single injection-molded part manufactured using a simple two-part mold.

The plate spacers 236 and 238 are the same distance away from each other as the spacing members 126 and 128 described above; the plate passageways 240 and 242 thus align with the base passageways 132 and 134 so that a fastener may extend through both the base member 32 and the plate 220 into the wall on which the mounting surface is formed.

Additionally, the plate spacers 236 and 238 are offset slightly from the center of the mounting plate 220; accordingly, when the base member 32 is attached to a wall through a mounting plate 220, the base member 32 is offset slightly from the center of the mounting plate 220. As best shown in FIG. 10, the offset spacers 236 and 238 leave adequate room for a handle portion 244 of the reel 22.

From the foregoing, it should be clear that the invention may be embodied in other specific forms without departing from the spirit or essential characteristics thereof. The present embodiments are therefore to be considered in all respects as illustrative and not restrictive.

I claim:

1. A system for storing a fishing reel having first and second tangs at a desired location on a mounting surface comprising:

a base member having first and second retaining walls and first and second detent members; and mounting means for mounting the base member at the desired location on the mounting surface; wherein said mounting means comprising:

a spacing member extending between the base member and the mounting surface; and a fastener extending through the spacing member into the mounting surface the first detent member is arranged relative to the first retaining wall to define a first gap and the second detent member is arranged relative to the second retaining wall to define a second gap;

the detent members deflect out of an original position when a force is applied thereto;

the tangs are inserted through the gaps such that the tangs engage and deflect the detent members and come into contact with inner surfaces of the retaining walls; and the deflected detent members hold the tangs against the inner surfaces of the retaining walls.

2. A system for storing a fishing reel having first and second tangs at a desired location on a mounting surface, comprising:

a base member having first and second retaining walls and first and second detent members; and mounting means for mounting the base member at the desired location on the mounting surface; wherein said mounting means comprising:

a spacing member extending between the base member and the mounting surface; and a fastener extending through the spacing member into the mounting surface the first detent member is arranged relative to the first retaining wall to define a first gap and the second detent member is arranged relative to the second retaining wall to define a second gap;

the detent members deflect out of an original position when a force is applied thereto;

the tangs are inserted through the gaps such that the tangs engage and deflect the detent members and come into contact with inner surfaces of the retaining walls; and the deflected detent members hold the tangs against the inner surfaces of the retaining walls a mounting plate located between the base member and the mounting surface, where the base member is offset from a center portion of the mounting plate.

3. A method of storing a fishing reel having first and second tangs at a desired location on a mounting surface, comprising the steps of:

providing a base member having first and second retaining walls and first and second detent members, the first detent member being arranged relative to the first retaining wall to define a first gap and the second detent member being arranged relative to the second retaining wall to define a second gap; and mounting the base member at the desired location on the mounting surface;

displacing the reel such that the first tang deflects the first detent member and enters the first gap;

pivoting the reel such that the second tang engages the second detent member;

displacing the reel such that the second tang deflects the second detent member and enters the second gap;

said base member being provided with a stop member that extends from the inner surface of the first retaining wall, wherein the step of displacing the reel such that the first tang enters the first gap comprises the step of displacing the reel such that the first tang extends slightly past the stop member.

4. A system for storing a fishing reel having first and second tangs at a desired location on a mounting surface, comprising:

a base member having first and second side walls, a top wall, a bottom wall, a first retaining wall connected to the side and top walls, a second retaining wall connected to the side and bottom walls, and a front wall connected between the side walls, and first and second detent members, where the first detent member extends from the front wall towards the first retaining wall and the second detent member extends from the front wall towards the second retaining wall;

a stop member extending from the inner surface of the first retaining wall; and mounting means for mounting the base member at the desired location on the mounting surface; wherein the first detent member is arranged relative to the first retaining wall to define a first gap and the second detent member is arranged relative to the second retaining wall to define a second gap;

the detent members deflect out of an original position when a force is applied thereto.

5. A system for storing a fishing reel having first and second tangs at a desired location on a mounting surface, comprising:

a base member having first and second side walls, a top wall, a bottom wall, a first retaining wall connected to the side and top walls, a second retaining wall connected to the side and bottom walls, and a front wall connected between the side walls, and first and second detent members, where the first detent member extends from the front wall towards the first retaining wall and the second detent member extends from the front wall towards the second retaining wall;

a stop member extending from the inner surface of the first retaining wall; and mounting means for mounting the base member at the desired location on the mounting surface; wherein the first detent member is arranged relative to the first retaining wall to define a first gap and the second detent member is arranged relative to the second retaining wall to define a second gap;

the detent members deflect out of an original position when a force is applied thereto;

the tangs are inserted through the gaps such that the tangs engage and deflect the detent members and come into contact with inner surfaces of the retaining walls; and the deflected detent members hold the tangs against the inner surfaces of the retaining walls;

a stop member extending from the inner surface of the first retaining wall.

6. A system for storing a fishing reel having first and second tangs at a desired location on a mounting surface, comprising:

a base member having first and second side walls, a top wall, a bottom wall, a first retaining wall connected to the side and top walls, a second retaining wall connected to the side and bottom walls, and a front wall connected between the side walls, and first and second detent members, where the first detent member extends from the front wall towards the first retaining wall and the second detent member extends from the front wall towards the second retaining wall;

a stop member extending from the inner surface of the first retaining wall; and mounting means for mounting the base member at the desired location on the mounting surface; wherein the first detent member is arranged relative to the first retaining wall to define a first gap and the second detent member is arranged relative to the second retaining wall to define a second gap;

the detent members deflect out of an original position when a force is applied thereto;

the tangs are inserted through the gaps such that the tangs engage and deflect the detent members and come into contact with inner surfaces of the retaining walls; and the deflected detent members hold the tangs against the inner surfaces of the retaining walls said mounting means comprising:

first and second spacing members connected to the front wall, the spacing members defining base passageways that terminate at one end at first and second openings formed in the frontwall;

first and second fasteners extending through the first and second base passageways.

7. An apparatus for storing a fishing reel comprising first and second oppositely extending tangs with outer end portions of the tangs being spaced from one another by a first spacing distance, said apparatus comprising:

a) a base member having a front side and a rear side, said base member having upper and lower front retaining walls;

b) said upper wall having a lower part with a downwardly facing top edge and said lower wall having an upper part an upwardly facing bottom edge, said top and bottom edges defining an entryway for the tangs of the reel, said top and lower edges being spaced from one another by a second spacing distance less than said first spacing distance of the outer ends of the tangs;

c) the base member being configured and arranged to define a recess having a middle recess portion at said entryway, an upper recess portion behind the upper wall and a lower recess portion behind the lower wall, one of said upper and lower recess portions being sufficiently open and having sufficient vertical depth to permit one of said tangs to be moved through the entry way and into said one of the upper and lower recess portions a sufficient distance to permit the other of said tangs to able to pass over an adjacent edge that is positioned oppositely to the recess portion in which said one of the tangs is positioned, and thence be positioned in the other of said upper and lower recess portions so that the reel is in its stowed position d) a deflectable and resilient retaining component positioned at said recess to engage said reel as the reel is being moved into its stowed position, with the retaining component being deflected rearwardly so that the retaining component exerts a forward force on the reel, so that with the tangs in respective retaining positions behind the upper and lower walls, respectively, the retaining component urges the reel forwardly to cause the tangs to press against the upper and lower walls to hold the reel in its stowed position.

8. The apparatus as recited as in claim 7, wherein said retaining component comprises upper and lower retaining members adapted to engage an upper positioned tang and a lower positioned tang to press said tangs against the upper and lower retaining walls.

9. The apparatus as recited in claim 8, wherein said upper and lower retaining members have mounting portions connecting at a central location to said base member, and said upper retaining members extends upwardly from it's mounting portion and said lower retaining member extends downwardly from it's mounting portion.

10. The apparatus as recited in claim 9, wherein said upper retaining member has an upper end which is no higher than the top edge of the upper wall, and a lower end of the lower retaining member is no lower than the edge of the bottom wall.

11. The apparatus as recited in claim 8, wherein the base member further comprises a front wall arranged between the upper and lower walls and the retaining members extend from the front wall.

12. A storage system as recited in claim 3, comprising a plurality of mounting plates and base members, where the mounting plates are arranged edge to edge in a grid such that they space the base members from each other.

13. A method as recited in claim 4, in which the step of displacing the reel such that the second tang enters the second gap comprises the step of displacing the reel such that the first tang no longer engages the stop member.

14. A storage system further as recited in claim 7, further comprising a mounting plate, where the mounting plate defines plate passageways that, when aligned with the base passageways, allow the mounting plate to be mounted between base member and the mounting surface such that the base member is offset from a center of the mounting plate.

15. A storage system as recited in claim 14, comprising a plurality of mounting plates and base members, where the mounting plates are arranged edge to edge in a grid such that they space the base members from each other.

* * * * *